US008813701B2

(12) United States Patent
Lengfeld et al.

(10) Patent No.: US 8,813,701 B2
(45) Date of Patent: Aug. 26, 2014

(54) ADJUSTMENT DEVICE FOR A VALVE DRIVE MECHANISM OF AN INTERNAL COMBUSTION ENGINE

(75) Inventors: Markus Lengfeld, Winnenden (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 17 days.

(21) Appl. No.: 13/695,034

(22) PCT Filed: Apr. 16, 2011

(86) PCT No.: PCT/EP2011/001946

§ 371 (c)(1), (2), (4) Date: Oct. 28, 2012

(87) PCT Pub. No.: WO2011/147506

PCT Pub. Date: Dec. 1, 2011

(65) Prior Publication Data

US 2013/0055976 A1 Mar. 7, 2013

(30) Foreign Application Priority Data

May 27, 2010 (DE) ..... 10 2010 021 774

(51) Int. Cl.
*F01L 1/34* (2006.01)

(52) U.S. Cl.
USPC ..... 123/90.17; 123/90.11; 123/90.15; 251/129.01; 464/160

(58) Field of Classification Search
USPC ..... 123/90.17, 90.11, 90.15; 251/129.01; 464/160
See application file for complete search history.

(56) References Cited

U.S. PATENT DOCUMENTS

| | | | | |
|---|---|---|---|---|
| 7,032,552 | B2 * | 4/2006 | Schafer et al. | 123/90.17 |
| 2007/0204825 | A1 | 9/2007 | Watanabe | |

FOREIGN PATENT DOCUMENTS

| | | |
|---|---|---|
| DE | 10 2004 045 631 | 4/2004 |
| DE | 10 2004 033 522 | 2/2006 |
| DE | 10 2005 022 201 | 6/2006 |
| DE | 10 2005 037 158 | 2/2007 |
| DE | 10 2006 028 554 | 1/2008 |
| DE | 10 2008 043 670 | 5/2010 |
| DE | 10 2008 043 671 | 5/2010 |
| DE | 10 2008 043 672 | 5/2010 |
| DE | 10 2008 043 673 | 5/2010 |
| JP | 2005 146993 | 6/2005 |
| JP | 2007 071261 | 3/2007 |
| JP | 2008 031905 | 2/2008 |
| WO | WO 03/095803 | 11/2003 |
| WO | WO 2005/061861 | 7/2005 |

* cited by examiner

*Primary Examiner* — Ching Chang
(74) *Attorney, Agent, or Firm* — Klaus J. Bach

(57) ABSTRACT

In a phase adjustment device for a valve drive mechanism of an internal combustion engine, in particular a camshaft adjustment device, with a phase adjustment unit which, for adjusting a phase position in a normal operating mode, comprises a coupling unit for controlling an adjustment gear element by applying a braking force, and with a failsafe adjustment arrangement for setting a defined fail-safe phase position in a fail-safe operating mode, the adjustment unit includes mechanical means for varying the braking force of the coupling unit of the phase adjustment unit for setting the phase angle to a controllable failsafe phase angle position.

13 Claims, 2 Drawing Sheets

ADJUSTMENT DEVICE FOR A VALVE DRIVE MECHANISM OF AN INTERNAL COMBUSTION ENGINE

This Application is a 35 U.S.C. 371 of PCT/EP2011/001946 filed on Apr. 16, 2011, and claiming the priority of German patent application 10 2010 021 774.3 filed May 27, 2010.

BACKGROUND OF THE INVENTION

The invention concerns an adjustment device for a drive mechanism of an internal combustion engine, in particular a camshaft adjusting device for adjusting the phase angle of the camshaft relative to the crankshaft.

From DE 10 2005 037 158 A1 an adjusting device is already known for a valve drive mechanism of an internal combustion engine, in particular a camshaft adjusting device, comprising a phase adjustment unit. The phase adjusting unit adjusts a phase angle position of the camshaft during a normal operating mode. It has a coupling unit acting upon an adjustment drive element with a braking force and comprising an adjustment unit provided in order to set a defined fail-safe phase position in at least one fail-safe operating mode.

It is the principle object of the invention to provide an inexpensive and simple adjusting device for the phase adjustment of a camshaft.

SUMMARY OF THE INVENTION

In a phase adjustment device for a valve drive mechanism of an internal combustion engine, in particular a camshaft adjustment device, with a phase adjustment unit which, for adjusting a phase position in a normal operating mode, comprises a coupling unit for controlling an adjustment gear element by applying a braking force, and a failsafe adjustment arrangement for setting a defined fail-safe phase position in a fail-safe operating mode, the adjustment unit includes mechanical means for varying the braking force of the coupling unit of the phase adjustment unit for setting the phase angle to a controllable failsafe value.

It is proposed that at least in the fail-safe operating mode the adjustment unit is capable to vary the braking force of the coupling unit of the phase adjustment unit. This eliminates the need for a separate coupling unit for setting the fail-safe phase position, so that fewer components are needed. The complexity and weight of the adjusting device can thereby be kept low, so that the device is inexpensive and simple. "Adjustment unit" is understood in particular to mean a unit provided in order, independently of an electronic control system can set a defined phase position which constitutes the fail-safe phase position. "Adjustment drive element" is understood in particular to mean a transmission element of an adjusting drive by which the phase position and/or the adjustment of the phase position can be established. In this context "adjustment drive" means in particular a three-shaft minus summation gear system by means of which the phase position can be adjusted. "Provided" means, in particular, specially equipped and/or designed.

It is further proposed that the coupling unit is provided to set the fail-safe phase position in a fail-safe operating mode and to set an adjustment angle in a normal operating mode. In this way the one coupling unit can advantageously be used for both the fail-safe and the normal operating modes, so that no complex actuator system for controlling two coupling units is needed.

It is further proposed that the phase adjustment unit comprises a magnetic actuator system which, to set the adjustment angle, is provided in order to adjust the braking force of the coupling unit magnetically, In this way a simple and effective phase adjustment unit is obtained. In this context "magnetically adjustable phase adjustment unit" should in particular be understood to mean a phase adjustment unit which, to set the phase position, is acted upon at least partially by a magnetic force, so that the phase position can be set by adjusting the magnetic force. "Magnetic force" is in particular understood to mean a force that can be produced by means of a magnetic flux of a magnetic field. A "magnetic actuator system" should in particular be understood to mean a unit for producing an adjustable magnetic field and/or magnetic flux, as for example a unit with at least one solenoid for forming an electromagnet.

In addition it is proposed that the magnetic actuator system is provided in order, in a normal operating mode, to set an adjustment angle at which the adjusting unit regulates the phase position. In this way the phase position can be set simply by means of the magnetic actuator system by an adjustment to a defined adjustment angle, in particular starting from the fail-safe phase position as the basis phase position, whereby this regulation to the specified adjustment angle can advantageously be carried out by the adjustment mechanics of the fail-safe unit.

The adjustment unit preferably comprises a mechanical adjustment system provided in order to control the phase position to the fail-safe phase position and/or the adjustment angle. In this way, even if the normal operating mode is in operative action, a phase position to a specified angle can be achieved mechanically, whereby the operational reliability of the phase adjustment device can be advantageously increased. In this context "mechanical adjustment system" should in particular be understood to mean a unit which converts a change of phase position solely by means of mechanical components into an adjustment of the magnetic elements. In particular this is understood to mean a unit independent of electric, pneumatic and/or hydraulic actuators.

It is further proposed that the adjustment unit comprises at least one permanent magnet which produces a magnetic field for actuating a clutch unit. In this way an advantageous fail-safe operating mode can be established, since the adjustment unit sets the fail-safe phase position autonomously and independently of any external control.

In an advantageous further development of the invention it is proposed that the adjustment unit comprises at least two magnetic elements that can be displaced relative to one another, which are provided in order to vary by mechanical means a magnetic force for adjusting the braking force. In this way the adjustment unit can adjust the phase position in a simple manner, in that it changes the magnetic flux advantageously by means of the magnetic elements being displaceable relative to one another. In particular this provides reliable and simple mechanical regulation for the fail-safe operating mode. In this context "magnetic element" is in particular understood to mean a magnetizable and/or magnetized element. In particular this is understood to be a ferromagnetic element, such that the magnetic element can basically be magnetically soft or magnetically hard. "Mechanical variation of the magnetic force" is in particular understood to mean that a mechanical displacement of the magnetic elements relative to one another brings about a change of the magnetic force.

Furthermore, it is advantageous for the coupling unit to comprise a positionally fixed stator and at least a first coupling element attached axially movably on the stator. In this way a tolerance compensation between the stator of the coupling unit and a rotor of the coupling unit can be realized in a simple manner. In particular, axial tolerances can thus be simply compensated, whereby an advantageous wear compensation can be achieved. Basically, thanks to a design according to the invention radial tolerance compensation too can be achieved.

It is also proposed that the coupling unit comprises at least one further coupling element attached on the stator, arranged spatially a distance away from the first coupling element. This permits a tolerance compensation between the stator of the coupling unit and a rotor of the coupling unit in a simple manner. Axial tolerances in particular can thereby be compensated for so that an advantageous wear compensation can be obtained. Basically, the design according to the invention provides also for radial tolerance compensation.

It is particularly preferable for the at least one coupling element to be connected axially movably to the stator. In this way a closed magnetic flux conducting unit can be formed, whereby the magnetic flux for actuating the coupling unit can be directed and influenced particularly advantageously.

Moreover, it is advantageous for the at least one coupling element to be made of a magnetizable material. Thereby the coupling elements can advantageously be in the form of magnetic flux coupling elements for conducting a magnetic flux provided for actuating the coupling unit. A "magnetic flux conducting element" is in particular understood to be a magnetically soft magnetic element which can only have a magnetic field induced by an external magnetic field. In particular "magnetic flux conducting element" cannot be a permanently magnetic element.

It is also proposed that the coupling unit comprises an axially positionally fixed rotor at least part of which is made of a magnetizable material. In this way corresponding second coupling elements attached on the rotor can be made particularly simply. Advantageously, by virtue of the rotor the coupling elements are made integrally with one another. Moreover, in that way the magnetic flux can advantageously be passed through the rotor. An "axially positionally fixed rotor" is in particular understood to mean a rotor whose axial position is maintained when the coupling unit is actuated. Advantageously, the rotor has two second coupling elements connected fixed to the rotor.

The invention will become more readily apparent from the following description of a particular embodiment thereof with reference to the accompanying drawings. The drawings, the description and the claims contain numerous characteristics in combination. Those with knowledge of the field will be able, appropriately, to consider the said characteristics also in isolation and to combine them in other suitable combinations.

DESCRIPTION OF A PARTICULAR EMBODIMENT

Figure 1:
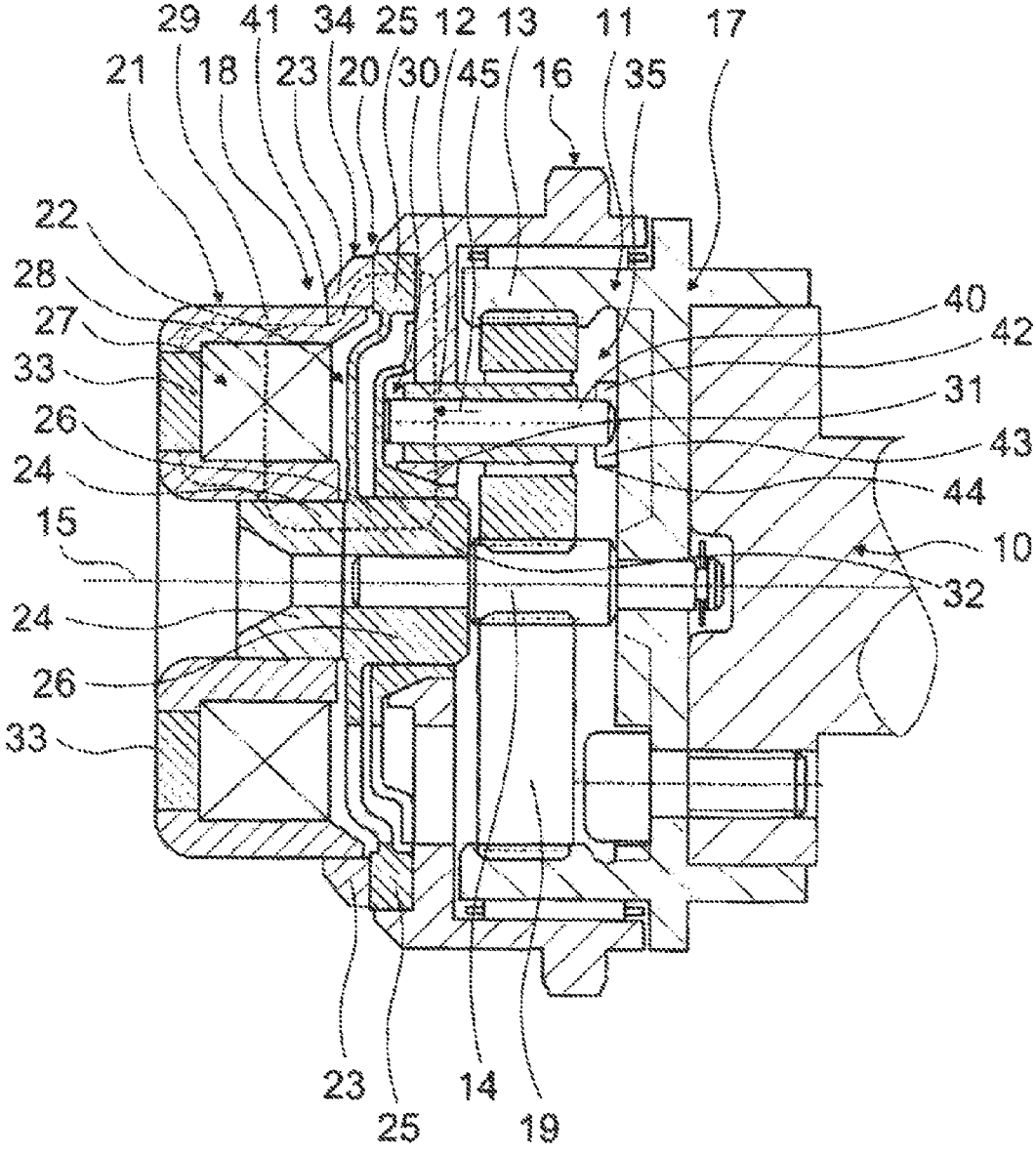
FIG. 1: shows in a cross-sectional view a valve drive mechanism of an internal combustion engine with an adjusting device according to the invention, shown.
Figure 2:
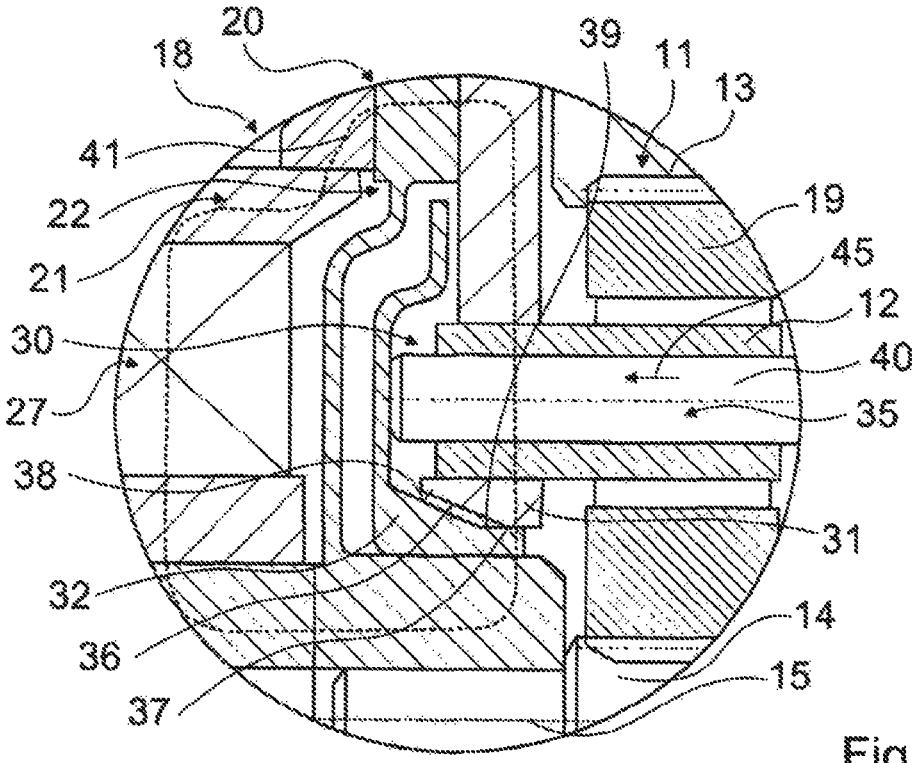
FIG. 2: shows a section of the adjustment device in a central set phase position.
Figure 3:
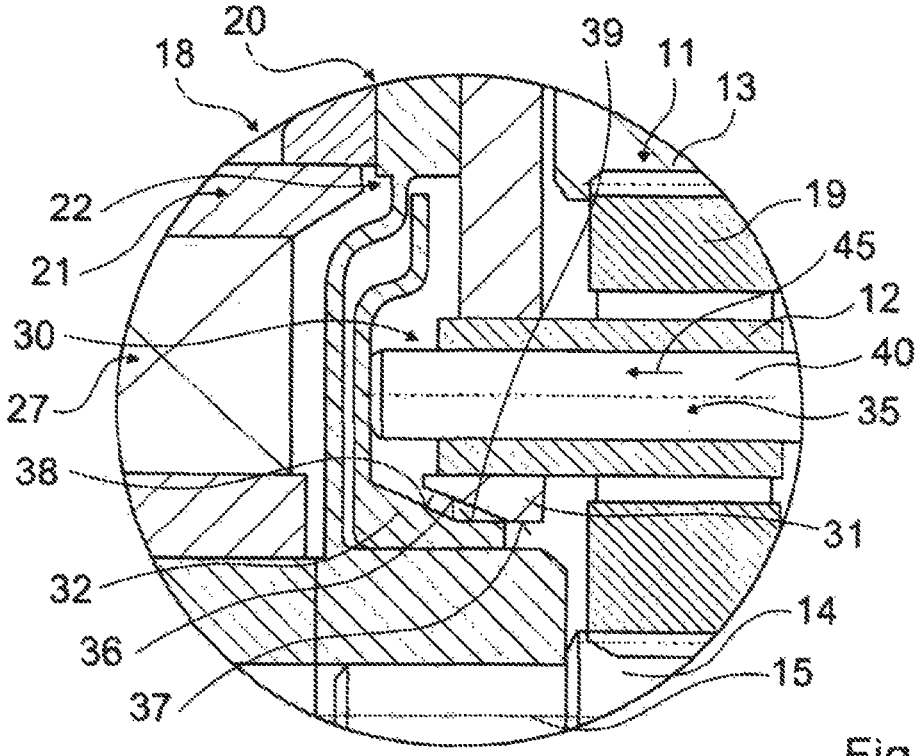
FIG. 3: shows the section shown in FIG. 2, with the phase position displaced to a retarded position.

FIGS. 1 to 3 show an example embodiment of a valve drive mechanism of an internal combustion engine with an adjusting device according to the invention. The internal combustion engine valve drive mechanism comprises a camshaft 10 driven by a crankshaft (not shown). The camshaft 10 is connected to the crank-shaft by means of a chain drive. In this case the rotation speed of the camshaft 10 is half the rotation speed of the crankshaft. The adjusting device is in the form of an electromagnetic camshaft adjustment device. It is designed for use in an internal combustion engine of a motor vehicle.

To adjust the phase position, the adjusting device comprises an adjustment transmission 11. The adjustment transmission 11 is in the form of a 3-shaft minus summation gear system. It comprises three adjustment gear elements 12, 13, 14 by means of which the phase position of the camshaft 10 can be adjusted. The adjustment transmission 11 is for example in the form of a planetary gear transmission. The adjustment mechanism has a main rotation axis 15 around which the three adjustment gear elements 12, 13, 14 are arranged to rotate. Basically however, other 3-shaft minus summation gear systems also are conceivable.

To introduce a torque the adjusting device has a drive unit 16 which comprises the first adjustment gear element 12. The adjustment gear element 12 is in the form of a planetary gear carrier which guides the planetary gears 19 of the adjustment transmission 11 round a circular path. The drive unit 16 also has a chain sprocket wheel connected rotationally fixed to the adjustment gear element 12. The drive unit 16 is connected to the crankshaft by way of the said sprocket wheel. To transmit the torque the adjusting device has a drive output unit 17 which comprises the second adjustment transmission element 13. The adjustment transmission element 13 is in the form of a ring gear which meshes with the planetary gears 19 supported by the planetary carrier. The adjustment transmission element 13 is connected rotationally fixed to the camshaft 10. To adjust the phase position the adjusting device comprises a phase adjustment unit 18 which comprises the third adjustment transmission element 14. The adjustment transmission element 14 is a sun gear which also meshes with the planetary gears 19 sipported by the planetary carrier.

For setting the phase position the phase adjustment unit 18 comprises a coupling unit 20. The coupling unit 20 is designed as a brake unit. The coupling unit 20 has an actuation direction orientated parallel to the main rotation axis 15. The coupling unit 20 comprises a positionally fixed stator 21 and a rotor 22. The rotor 22 is attached rotationally and axially fixed on the third adjustment transmission element 14. It is therefore in an axially fixed position. A braking torque provided by the coupling unit 20 acts upon the third adjustment transmission element 14. By means of the coupling unit 20 a rotation speed of the adjustment transmission element 14 can be set in a defined manner. The coupling unit 20 comprises two first coupling elements 23, 24 connected rotationally fixed to the stator 21 and two second coupling elements 25, 26 connected rotationally fixed to the rotor 22. The coupling elements 23, 24, 25, 26 have in each case a friction surface. The two coupling elements 23, 25, whose friction surface can be brought into frictional contact with one another, are arranged radially on the outside. The two coupling elements 24, 26 whose friction surfaces can be brought into frictional contact with one another are arranged radially on the inside. The coupling elements 23, 24 connected rotationally fixed to the stator 21 and the coupling elements 25, 26 connected rotationally fixed to the rotor 22 are in each case arranged spatially apart from one another.

The radially outer first coupling element 23 is ring-shaped. The first coupling element 23 has an inside diameter which is larger than an outer diameter of the stator 21. The radially outer coupling element 23 surrounds the stator 21. The stator 21 is arranged nested within the coupling element 23. The radially inner first coupling element 24 is also ring-shaped. The outer diameter of the coupling element 24 is smaller than the inside diameter of the stator 21. The stator 21 surrounds the radially inner coupling element 24. The coupling element 24 is arranged nested within the stator 21.

The stator 21 is ring-shaped. On an outer envelope surface the stator 21 has external teeth. On an inner envelope surface the stator 21 has internal teeth. The external and internal teeth are straight-fluted teeth. Basically, both the external and internal teeth can have other tooth shapes.

The two coupling elements 23, 24 are made separate from one another. The outer coupling element 23 has inner teeth that correspond with the external teeth of the stator 21. The outer coupling element 23 engages by its inner teeth with the external teeth of the stator 21. Along its axially directed actuation direction the coupling element 23 is coupled movably within the stator 21. The inner coupling element 24 has outer teeth that correspond with the internal teeth of the stator 21. The inner coupling element 24 engages by its outer teeth with the internal teeth of the stator 21. Along its axially directed actuation direction the coupling element 24 is coupled movably with the stator 21. By virtue of the axial teeth the two coupling elements 23, 24 are connected rotationally fixed but axially movably with the stator 21. In relation to movement along the actuation direction the two coupling elements 23, 24 can move independently of one another.

The rotor 22 is arranged along the main rotation axis 15 axially between the stator 21 and the adjustment transmission element 12. Two partial components of the rotor 22 form the coupling elements 25, 26. The parts of the rotor 22 forming the coupling elements 25, 26 are made of a magnetizable material. The part of the rotor 22 forming the coupling element 25 is in the form of an axially outer area of the rotor 22. The part of the rotor 22 forming the coupling element 26 is an axially inner area of the rotor 22. The two parts of the rotor 22 are fixed to one another by a connection piece. Thus, the rotor 22 as a whole is made integrally of one material. In the said parts the rotor 22 has an axial thickness greater than the axial thickness of the connection piece. By virtue of the rotor the two coupling elements 25, 26 are formed integrally.

The phase adjustment unit 18 can be controlled magnetically. The phase adjustment unit 18 comprises a magnetic actuator 27 by means of which an adjustable magnetic field can be produced for setting the phase position. The magnetic actuator 27 comprises a solenoid 28 (not shown in detail) by means of which a magnetic field can be produced, which passes through the coupling elements 23, 24, 25, 26 of the coupling unit 20. To position the solenoid 28 the magnetic actuator 27 has a yoke element 29 fixed on an engine block (not shown) of the internal combustion engine. The yoke element 29 forms the stator 21 of the coupling unit 20.

Viewed in semi-section the yoke element 29 is U-shaped. The solenoid 28 is arranged in an inside space spanned by the yoke element 29. An opening of the yoke element 29 is directed toward the rotor 22. The inside space spanned by the yoke element 29 extends in a ring shape around the main rotation axis 15. The solenoid 28 has a coil winding arranged in the inside space spanned by the yoke element 29. Relative to the main rotation axis 15 the coil winding extends circumferentially. The coil axis of the solenoid 28 is directed coaxially with the main rotation axis 15. When the solenoid 28 is energized with current a magnetic field can be produced, which in the area of the solenoid 28 passes essentially within the yoke element 29.

The coupling elements 23, 24, 25 26 are made of a magnetizable material. The coupling elements 23, 24, 25 26 of the coupling unit 20 are magnetically coupled with one another. The magnetic force by which the phase position can be set produces a force of attraction between the coupling elements 23, 24, 25 26. Thus, the braking force of the coupling unit 20 depends directly on the magnetic force. In turn, the magnetic force is proportional to the magnetic flux passing through the coupling elements 23, 24, 25 26 of the coupling unit 20. The coupling elements 23, 24, 25 26 are in the form of flux conducting elements, i.e. they are made of a magnetically soft material. Thus, the coupling elements 23, 24, 25 26 are provided only to direct the magnetic flux. They do not produce any magnetic field of their own.

To set a defined fail-safe phase position the adjusting device comprises an adjustment unit 30. The adjustment unit 30 is independent of the magnetic actuator 27. The adjustment unit 30 can displace the phase position between the drive input unit 16 and the drive output unit 17 independently of the functionality of the magnetic actuator 27. Thus, the adjustment unit 30 forms an autonomous unit which can adjust the camshaft 10 independently of any external energy supply.

The adjustment unit 30 comprises two magnetic elements 31, 32 which can be moved relative to one another, by means of which the magnetic force acting on the coupling elements 23, 24, 25 26 can be varied mechanically. In addition the adjustment unit 30 comprises a permanent magnet 33 which produces a magnetic field independently of the magnetic actuator 27, whose magnetic flux passes through the coupling elements 23, 24, 25 26. The permanent magnet 33 is integrated in the yoke element 29. The magnetic field produced by the permanent magnet 33 is provided in a fail-safe operating mode and in a normal operating mode for adjusting the braking force produced by the coupling unit 20. The magnetic flux, which in the fail-safe operating mode is produced by the permanent magnet 33, is varied by the magnetic actuator 27 during the normal operating mode.

To conduct the magnetic fields that can be produced by the permanent magnet 33 and the magnetic actuator 27, the adjusting device comprises a magnetic flux conducting unit 34 formed by the adjustment gear system 11, the phase adjustment unit 18 and the adjustment unit 30. The magnetic flux conducting unit 34 as a whole is made of magnetizable materials. The magnetic flux produced by the magnetic field can be described by magnetic field lines 41 emerging from the permanent magnet 33 and the magnetic actuator 27. The magnetic field lines 41 always form closed field lines. The magnetic flux conducting unit 34 offers less magnetic resistance to the magnetic flux compared with air. The magnetic field lines 41 influenced by the magnetic flux conducting unit 34 run within the magnetizable material. Thus, the magnetic flux conducting unit can be completely closed, i.e. the magnetic field lines 41 influenced by the magnetic flux conducting unit 34 run almost completely within the magnetizable material.

In an operating condition in which the magnetic field is produced only by the permanent magnet 33, the magnetic field lines 41 emerge from the permanent magnet 33. In an operating condition in which the magnetic field is produced conjointly by the permanent magnet 33 and the magnetic actuator 27, some of the magnetic field lines 41 again emerge from the permanent magnet 33. Thus, the magnetic flux described below is understood to be part of a total magnetic flux that can be produced by the magnetic actuator 27 and the permanent magnet 33. Basically other magnetic field lines too may exist, which pass through some areas outside the magnetic flux conducting unit 34.

The magnetic field lines 41 produced by the permanent magnet 33 pass through the phase adjustment unit 18, the adjustment gearing 11 and the adjustment unit 30. Starting from the permanent magnet 33 the magnetic flux first passes through the yoke element 29. The coupling element 23 is immediately adjacent to the yoke element 29, so that the magnetic flux is passed on from the yoke element 29 into the coupling element 23. Starting from the coupling element 23, the magnetic flux passes via the coupling element 25 into the adjustment gear element 12 that is the planetary gear carrier. Then the magnetic flux passes through the two magnetic elements 31, 32 of the adjustment unit 30. The magnetic element 32 is immediately adjacent to the rotor 22 of the coupling unit 20, through the radially inner component of which the magnetic flux passes into the coupling element 26. From the coupling element 26 the magnetic flux passes through the coupling element 24, which is immediately adjacent to the yoke element 29. In turn, the yoke element 29 passes the magnetic flux back to the permanent magnet 33, whereby the magnetic flux circuit is completely closed.

The stator 21, whose yoke element 29 therefore forms part of the magnetic flux conducting unit 34, is thus partly associated with the magnetic flux conducting unit 34. Furthermore, the magnetic flux conducting unit 34 is associated with the adjustment gear element 12 of the adjustment gearing 11. In addition the two magnetic elements 31, 32 of the adjustment unit 30 form part of the magnetic flux conducting unit 34. Besides, the rotor 22 of the coupling unit 20 is partially associated with the magnetic flux conducting unit 34. In addition the four coupling elements 23, 24, 25 26 are associated with the magnetic flux conducting unit 34.

Independently of the operating condition of the coupling unit 20, the coupling elements 23, 25 are always in contact. The part of the rotor 22 that forms the coupling element 25 is supported by a slide bearing against the first adjustment gear element 12. In the area of the coupling element 25 the rotor 22 and the first adjustment gear element 12 are magnetically connected to one another, The adjustment gear element 12 forms the first magnetic element 31 of the adjustment unit 30. The magnetic element 31 and the magnetic element 32 can also be connected together magnetically by way of a mutual contact surface. The magnetic element 32 is fitted on the rotor 22 with a slide bearing and is thus magnetically connected to the part of the rotor 22 which forms the coupling element 26. In turn, regardless of the operating condition of the coupling unit 20 the coupling elements 24, 26 are always in contact. Thus, in an operating condition in which the two magnetic elements 31, 32 have a contact area greater than zero, the magnetic flux conducting unit 34 is magnetically closed. The magnetic resistance of the magnetic flux conducting unit 34 can be adjusted by means of the adjustment unit 30 by way of the mutual contact area of the magnetic elements 31, 32. The magnetic elements 31, 32 can also be separated completely from one another i.e. the magnetic flux can even be interrupted by the said elements 31, 32.

In relation to the magnetic field lines 41 the coupling unit 20 and the magnetic elements 31, 32 are arranged magnetically in series. The magnetic field lines 41 pass, one after another, through the coupling elements 23, 25, the two magnetic elements 31, 32 and the coupling elements 24, 26. The magnetic elements 31, 32 are formed as magnetic flux conducting elements. They are made from a magnetically soft material. The magnetic field produced by the permanent magnet 33 has a magnetic flux which is passed through the adjustment unit 30 in a defined manner by means of the magnetic elements 31, 32. In relation to the magnetic elements 31, 32 the adjustment gearing element 12 is arranged magnetically in series by way of the coupling elements 23, 24 of the stator 21 and the coupling elements 25, 26 of the rotor 22. Along the magnetic field lines 41 the coupling elements 23, 24 of the stator 21 can be connected magnetically to one another by way of the adjustment gearing element 12 and the magnetic elements 31 and 32.

To adjust the magnetic force the adjustment unit 30 comprises an adjustment mechanism 35 which, in the fail-safe operating mode, displaces the two magnetic elements 31, 32 relative to one another. The adjustment mechanism 35 is coupled to the two adjustment gear elements 12, 13. It pushes the two magnetic elements 31, 32 relative to one another if the phase position defined by the adjustment gear elements 12, 13 changes. The size of the contact area between the two magnetic elements 31, 32 can be varied by means of the adjustment mechanism 35. The adjustment unit 30 sets the size of the said contact area as a function of the phase position.

The two magnetic elements 31, 32 are partially wedge-shaped. The first magnetic element 31 has a contact surface region 36 which is inclined at an angle of around 25 degrees relative to the movement direction of the magnetic elements 31, 32. In addition the magnetic element 31 has a contact surface region 37 orientated along the said movement direction. The second magnetic element 32 also has a contact surface region 38 inclined relative to the movement direction and a contact surface region 39 orientated along the movement direction. The contact surface regions 36, 38 and the contact surface regions 37, 39 can in each case be brought into contact with one another. The contact surface of the two magnetic elements is designed as an area in which the magnetic elements 31, 32 touch one another, i.e. an area in which the contact surface regions 36, 37 are partly or completely in contact with the contact surface regions 38, 39. To set the fail-safe phase position the adjustment unit 30 varies the size of the said contact surfaces. The size of the contact surfaces can be adjusted by means of the adjustment mechanism 35 of the adjustment unit 30. To change the contact area, the adjustment mechanism 35 moves the two magnetic elements 31, 32 relative to one another. Herein the movement direction of the magnetic elements 31, 32 is parallel to the main rotation axis 15 of the adjusting device.

To displace the two magnetic elements 31, 32 the adjustment mechanism 35 of the adjustment unit 30 has an actuator element 40. The actuator element 40 is coupled along its actuation direction 45 to the magnetic element 32. The actuator element 40 is in the form of an axially movable thrust pin mounted relative to the second adjustment gear element 13. The actuator element 40 passes through the first adjustment gear element 12, relative to which the actuator element 40 is mounted so as to be able to move axially. The actuator element 40 passes through the planetary gears 19. It is fitted on slide bearings within the first adjustment gear element 12. The actuation direction 45 along which the actuator element 40 can be displaced, is orientated parallel to the main rotation axis 15 of the adjusting device.

In addition, the adjustment mechanism 35 of the adjustment unit 30 comprises a thermoelement 42 by means of which the fail-safe phase position can be set in a temperature-dependent manner. The thermoelement has a geometry designed for the adjustment of the phase position, which varies as a function of an operating temperature. The fail-safe phase position is set by virtue of the temperature-dependence of the geometry of the thermoelement 42. The thermoelement 42 forms an inclined surface 43 by means of which a change of the phase position is converted into an axial displacement of the actuator element 40. The thermoelement 42 is connected fixed to the second adjustment gear element 13. The said inclined surface 43 is arranged on the second adjustment gear element 13.

The inclined surface 43 forms an adjustment ramp 44 whose height decreases along a displacement of the phase position in the retard direction. The actuator element 40 mounted to move axially is coupled along its actuation direction 45 to the thermoelement 42. During an adjustment of the phase position the adjustment gear elements 12, 13 rotate relative to one another, whereby the actuator element 40 moves on the inclined surface 43 formed by the thermoelement 42. The thermoelement 42 converts a change of the phase position into a linear movement of the actuator element 40.

Due to the movement of the actuator element 40 in the circumferential direction on the inclined surface 43 the thermoelement 42 pushes the actuator element 40 in the axial direction. When the phase position is displaced from advance toward the retard direction the inclined surface 43 moves the actuator element 40 in the direction toward the second adjustment transmission element 13. When the phase position moves from retard toward the advance direction the inclined surface 43 moves the actuator element 40 in the direction toward the first adjustment gear element 12.

The thermoelement is in the form of a bimetallic element. The bimetallic element is in the form of a bimetallic sheet whose main extension direction is directed circumferentially. At different operating temperatures the thermoelement 42 has different shapes. The thermoelement 42 changes a slope of the inclined surface 43 directed circumferentially as a function of the operating temperature. To form the inclined surface 43 the bimetallic thermoelement 42 is attached at one end to the second adjustment gear element 13. The end at which the thermoelement 42 is connected to the second adjustment gear element 13 is directed towards a phase position displacement in the advance direction. In a cold operating condition the thermoelement 42 is shaped in the direction of the first adjustment gear element 12. In the cold operating condition the oblique surface 43 has a large slope. In the cold operating condition the distance between an end of the thermoelement 42 remote from its attached end and the second adjustment gear element 13 is maximum. The distance decreases as the operating temperature increases. In a hot operating condition the thermoelement 42 forms a flatter ramp. The thermoelement 42 varies a displacement range of the actuator element 40 in which the actuator element 40 is displaced at maximum shift of the phase position as a function of the operating temperature. This becomes smaller as the operating temperature increases. In a cold operating condition the thermoelement 42 separates the contact surface regions 36, 37, 38, 39 of the magnetic elements 31, 32 of the adjustment unit 30 partially or completely from one another, depending on the phase position. In a very hot operating condition the magnetic elements 31, 32 are always completely connected with one another.

In a cold operating condition the thermoelement 42 displaces the actuator element 40, in an angle-dependent manner, axially in the direction toward the first adjustment gear element 12. In a hot operating condition the thermoelement 42 does not displace the actuator element 40 axially towards the first adjustment gear element 12. In this way the thermoelement 42 produces a respective defined fail-safe phase angle for different operating temperatures at which the internal combustion engine can be operated.

A change of the axial position of the actuator element 40 brings about a displacement of the magnetic elements 31, 32 relative to one another. Thus, the inclined surface 43 of the adjustment unit 30 converts a change of the phase position into a displacement of the magnetic elements 31, 32. Due to the displacement of the magnetic elements 31, 32, the size of the contact surface between the two magnetic elements 31, 32 changes, Thus, by means of the inclined surface 43 a magnetic resistance can be produced, in opposition to the magnetic flux of the flux condition unit. By virtue of the magnetic elements 31, 32 that can be moved relative to one another by means of the thermoelement 42 the magnetic flux passing through the coupling elements 23, 24, 25, 26 of the coupling unit 20, and hence the magnetic force between the said coupling elements 23, 24, 25, 26, can be varied directly by mechanical means. By virtue of the thermoelement 42 the mechanically adjusted magnetic resistance of the magnetic flow conducting unit 34 is temperature-dependent.

If the phase position is shifted in the retard direction, the contact area between the two magnetic elements 31, 32 is large. The magnetic resistance opposing the magnetic flux produced by the permanent magnet 33 is therefore small. Thus, the magnetic flux passing through the coupling elements 23, 24, 25, 26 of the coupling unit 20 is large, so the braking force produced by the coupling unit 20 is also large. Accordingly, the adjustment unit 30 produces a braking force by which the phase position is shifted in the advance direction (see FIG. 1).

If the phase position is shifted in the advance direction, the contact area between the two magnetic elements 31, 32 is small. The magnetic resistance that opposes the magnetic flux produced the by permanent magnet 33 is therefore large. Thus, the magnetic flux passing through the coupling elements 23, 24, 25, 26 of the coupling unit 20 is small, so the braking force produced by the coupling unit 20 is also small. Accordingly, the adjustment unit 30 produces a braking force by which the phase position is shifted in the retard direction (see FIG. 3).

Since the two coupling elements 23, 25 and the two coupling elements 24, 26 of the coupling unit 20 can only be actuated together, the four coupling elements 23, 24, 25, 26 form the one coupling unit 20. The adjustment unit 30 sets the fail-safe phase position since it varies the braking force of the coupling unit 20 of the phase adjustment unit 18. The coupling unit 20 is provided for the phase adjustment unit 18 and the adjustment unit 30. The adjusting device has only one coupling unit 20.

In an operating condition in which the rotation speed set for the third adjustment gear element 14 is the same as a rotation speed of the first adjustment gear element 12, a currently set phase position between the crankshaft and the camshaft 10 is kept constant. In an operating condition in which the speed of the third adjustment gear element 14 is higher than that of the first adjustment gear element 12, the phase position of the camshaft 10 is shifted in the retard direction. In an operating condition in which the speed of the third adjustment gear element 14 is lower than that of the first adjustment gear element 12, the phase position of the camshaft 10 is shifted in the advance direction.

To shift the phase position in the retard direction the coupling unit 20 is opened. During operation the camshaft 10 experiences a drag torque, for example caused by bearing points of the camshaft 10, due to which the camshaft 10 is moved in the retard direction. If the coupling unit 20 is open, owing to the drag torque of the camshaft 10 the speed of the third adjustment gear element 14 becomes higher than that of the first adjustment gear element 12. Accordingly, the camshaft 10 is shifted in the retard direction.

To maintain the current phase position, by means of the magnetic actuator 27 the phase adjustment unit 18 produces a magnetic field strength whose magnetic force exactly creates a required braking force in the coupling unit 20. The said braking force is adjusted to a value at which the rotation speed of the third adjustment gear element 14 is equal to that of the first adjustment gear element 12 (see FIG. 2).

To shift the phase position in the advance direction the coupling unit 20 is closed. The speed of the third adjustment gear element 14 becomes smaller than that of the first adjustment gear element 12. Thus the speed of the second adjustment gear element 13 becomes higher than that of the first adjustment gear element 12, so the camshaft 10 is shifted in the advance direction.

In the fail-safe operating mode the adjustment unit 30 regulates the phase position of the camshaft 10 mechanically to the fail-safe phase position, To set the fail-safe phase position the adjustment unit 30 varies the braking force of the coupling unit 20 of the phase adjustment unit 18. Thanks to the thermoelement 42 the fail-safe phase position always corresponds to a basic phase position adapted to the operating temperature. In the fail-safe operating mode the adjustment unit 30 automatically regulates the phase position mechanically to the fail-safe phase position. In the fail-safe operating mode the magnetic actuator 27 of the phase adjustment unit 18 is not energized. The basic phase position is set by the adjustment unit 30, which by means of the magnetic elements 31, 32 produces a magnetic flux necessary for setting the corresponding braking force.

The adjustment unit 30 controls the phase position by means of the magnetic elements 31, 32. If, starting from the basic phase position, the phase position is shifted in the advance direction, the magnetic elements 31, 32 reduce the magnetic flux through the coupling elements 23, 24, 25, 26 whereby the braking force of the coupling unit 20 decreases. The adjustment unit 30 shifts the phase position mechanically in the retard direction. If, starting from the basic phase position, the phase position is shifted in the retarded direction, the magnetic elements 31, 32 increase the magnetic flux through the coupling elements 23, 24, 25, 26 whereby the braking force of the coupling unit 20 is increased. The adjustment unit 30 shifts the phase position mechanically in the advance direction. During this the adjustment unit 30 regulates the phase position autonomously, i.e. independently of any external control or regulation, to the fail-safe phase position in a stable manner.

In the normal operating mode, at average temperatures the adjustment unit 30 at first regulates the phase position of the camshaft 10 mechanically to the basic phase position. This basic phase position corresponds to the fail-safe phase position produced when a magnetic field of zero is set for the magnetic actuator 27. The phase adjustment unit 18 shifts the phase position by means of the magnetic actuator, starting from the basic phase position set by the adjustment unit 30. In order, starting from the basic phase position, to shift the phase position in the advance or retard direction, a magnetic field not equal to zero is set for the magnetic actuator 27 of the phase adjustment unit 18. In order, starting from the fail-safe phase position, to shift the phase position in the advance direction, a magnetic field is produced by means of the magnetic actuator 27 which reinforces the magnetic field of the permanent magnet 33. In order, starting from the fail-safe phase position, to shift the phase position in the retard direction, a magnetic field is produced by the magnetic actuator 27 which weakens the magnetic field of the permanent magnet 33.

In the normal operating mode, the coupling unit 20, which in the fail-safe operating mode is provided for setting the fail-safe phase position, is provided for setting a displacement angle. To set the displacement angle the magnetic actuator 27 of the phase adjustment unit 18 varies the braking force of the coupling unit 20 by varying the magnetic flux passing through the coupling elements 23, 24, 25, 26. The adjustment mechanism 35, which in the fail-safe operating mode moves the two magnetic elements 31 32 relative to one another, seeks in the second operating mode to regulate the phase position to a constant value by moving the two magnetic elements 31, 32 relative to one another. In the normal operating mode a current phase position is set by the magnetic actuator 27 independently of any control or regulation of the adjustment mechanism.

In an operating state, in which the fail-safe phase position is set and the magnetic actuator 27 is reinforcing the magnetic field, at first the magnetic flux passing through the coupling elements 23, 24, 25, 26 of the coupling unit 20 increases. The increased magnetic flux brings about a reinforcement of the braking force of the coupling unit 20, whereby the phase position is shifted in the advance direction, The result of shifting the phase position in the advance direction is that the adjustment mechanism 35 reduces the size of the contact area between the two magnetic elements 31, 32. This reduction of the contact area increases the magnetic resistance opposing the magnetic flux, and the braking force produced by the coupling unit 20 is reduced again. As soon as the braking force is reduced again by the phase position shift to a value at which the phase position is held constant, the phase position is shifted in the advance direction relative to the fail-safe phase position.

A shift of the phase position in the retard direction takes place analogously. In an operating state in which the fail-safe phase position is set and the magnetic actuator 27 reduces the magnetic field, at first the magnetic flux passing through the coupling elements 23, 24, 25, 26 of the coupling unit 20 is reduced. The reduced magnetic flux brings about a reduction of the braking force of the coupling unit 20, whereby the phase position is shifted in the retard direction. The result of this phase position shift in the retard direction is that the adjustment mechanism 35 increases the contact area between the two magnetic elements 31, 32. Due to the enlargement of the said contact area the magnetic resistance opposing the magnetic flux is reduced and the braking force produced by the coupling unit 20 increases again. As soon as the braking force is increased again to a value at which the phase position is held constant, the phase position is shifted in the retard direction relative to the fail-safe phase position.

Regardless of the shift direction of the phase position, the displacement angle through which the phase position is changed by means of the magnetic actuator 27 away from the basic phase position set by the adjustment unit 30 depends directly on the magnetic field produced by the magnetic actuator 27. The magnetic field produced by the magnetic actuator 27 defines only the displacement angle, i.e. the deviation from the basic phase position. Thus, in a temperature-dependent manner, the adjustment mechanism 35 of the adjustment unit 30 regulates the basic phase position mechanically to the displacement angle that can be set by means of the phase adjustment unit 18.

The thermoelement 42 of the adjustment mechanism 35, which adjusts the fail-safe phase position and thus the basic phase position in a temperature-dependent manner, displaces the basic phase position in the advance direction in a cold operating condition. In a hot operating condition the basic phase position is displaced in the retard direction.

The adjustment device comprises two end-stops (not shown) by means of which the entire angular range over which the phase position can be shifted, is restricted. The phase position can be adjusted within a range from zero degrees to 140 degrees. Zero degrees corresponds to a maximum shift of the phase position in the retard direction. 140 degrees corresponds to the maximum shift of the phase position in the advance direction.

In a hot operating condition the adjustment mechanism 35 sets the contact area of the magnetic elements 31, 32, on average, at a larger value than in a cold operating condition. Thus, a change of the magnetic field brought about by the magnetic actuator 27 results in a larger change of the displacement angle in a hot operating condition than in a cold operating condition.

What is claimed is:

1. A camshaft adjustment device for a valve drive mechanism of an internal combustion engine, having a camshaft adjustment mechanism, comprising:

an adjustment gear element (14) with a phase adjustment unit (18) for adjusting a phase position of the camshaft in a normal operating mode, a coupling unit (20) acting on the adjustment gear element (14) with a braking force, and a fail-safe adjustment arrangement (30) for setting a defined fail-safe phase position in a fail-safe operating mode, the failsafe adjustment arrangement (30) including means for continuously varying the braking force of the coupling unit (20) of the phase adjustment unit (18) depending on a momentary phase position of the camshaft for adjusting the fail-safe phase position.

2. The camshaft adjustment device according to claim 1, wherein the coupling unit (20) is provided for setting the fail-safe phase position in a fail-safe operating mode and also for controlling the phase angle adjustment in a normal operating mode.

3. The camshaft adjustment device according to claim 2, wherein the phase adjustment unit (18) comprises a magnetic actuator (27) for setting an adjustment angle by controlling the braking force of the coupling unit (20).

4. The camshaft adjustment device according to claim 2, wherein the failsafe adjustment arrangement (30) comprises an adjustment mechanism (35), for adjusting the camshaft mechanically to a fail-safe phase position.

5. The camshaft adjustment device according to claim 1, wherein the adjustment arrangement (30) comprises at least one permanent magnet (33), which produces a magnetic field force for actuating the coupling unit (20).

6. The camshaft adjustment device according to claim 5, wherein the adjustment arrangement (30) comprises at least two magnetic elements (31, 32) which can be moved relative to one another for varying mechanically the magnetic field force for controlling the braking force.

7. The camshaft adjustment device according to claim 6, wherein the magnetic coupling elements (31, 32) are movable relative to one another by means of an actuator element (40) in contact with an inclined surface element (43) mounted on a camshaft output unit (17) which is phase adjustable relative to a drive unit (16) and connected to an engine crankshaft to be driven thereby so as to control the relative position of the two magnetic coupling elements (31, 32) and the strength of the magnetic circuit actuating the coupling unit (20) depending on the phase position of the camshaft relative to the crankshaft.

8. The camshaft adjustment device according to claim 7, wherein the actuator element (40) comprises a thermo-element (42) for changing the shape of the actuator element for changing the rate of change of the magnetic coupling element (31, 32) with a phase change of the camshaft relative to the crankshaft depending on an operating temperature of the internal combustion engine.

9. The camshaft adjustment device according to claim 1, wherein the coupling unit (20) comprises a positionally fixed stator (21) and at least a first coupling element (23) which is axially movably supported by the positionally fixed stator (21).

10. The camshaft adjustment device according to claim 9, wherein the coupling unit (20) comprises at least a second coupling element (24) axially movably supported by the positionally fixed stator (21), which is arranged spatially separated from the first coupling element (23).

11. The camshaft adjustment device according to claim 9, wherein, both, the first and the second coupling elements (23, 24) are axially movably supported by the positionally fixed stator (21).

12. The camshaft adjustment device according to claim 9, wherein the at least one coupling element (23, 24) consists of a magnetizable material.

13. The camshaft adjustment device according to claim 1, wherein the coupling unit (20) comprises an axially fixed rotor (22) which consists at least partially of a magnetizable material.

* * * * *